US005899191A

United States Patent [19]

Rabbit et al.

[11] Patent Number: 5,899,191

[45] Date of Patent: May 4, 1999

[54] AIR FUEL RATIO CONTROL

[75] Inventors: Andrew Rabbit, Yokine; David Richard Worth, Shenton Park; Thomas Schnepple, Wembley; Wayne Andrew Hawken, Langford, all of Australia

[73] Assignee: Orbital Engine Co., (Australia) Pty Ltd., Balcatta, Australia

[21] Appl. No.: 08/766,353

[22] Filed: Dec. 13, 1996

[30] Foreign Application Priority Data

Dec. 15, 1995 [AU] Australia ..... PN 7163

[51] Int. Cl.[6] ..... F02D 41/22

[52] U.S. Cl. ..... 123/479; 123/361; 123/399; 123/198 D; 701/114

[58] Field of Search ..... 123/479, 478, 123/497, 359, 361, 399, 396, 436, 198 D; 364/431.11; 318/565; 701/114

[56] References Cited

U.S. PATENT DOCUMENTS

| | | | |
|---|---|---|---|
| 4,471,742 | 9/1984 | Kishi | 123/478 |
| 4,785,222 | 11/1988 | Pfalzgraf et al. | 318/565 |
| 4,920,939 | 5/1990 | Gale | 123/399 |
| 5,065,721 | 11/1991 | Wiggins et al. | 123/479 |
| 5,204,816 | 4/1993 | Wright et al. | 364/431.11 |
| 5,345,915 | 9/1994 | Schmitz-Huebsch et al. | 123/497 |
| 5,365,904 | 11/1994 | Nofsinger et al. | 123/359 |
| 5,602,732 | 2/1997 | Nichols et al. | 123/361 |
| 5,669,353 | 9/1997 | Shirai et al. | 123/399 |
| 5,673,668 | 10/1997 | Pallett et al. | 123/436 |
| 5,823,164 | 10/1998 | Seki et al. | 123/396 |

FOREIGN PATENT DOCUMENTS

| | | |
|---|---|---|
| 0 536 567 A1 | 9/1992 | European Pat. Off. . |
| 40 04 085 A1 | 8/1991 | Germany . |
| 2 242 035 | 8/1991 | United Kingdom . |

*Primary Examiner*—Willis R. Wolfe
*Assistant Examiner*—Hieu T. Vo
*Attorney, Agent, or Firm*—Nikaido Marmelstein Murray & Oram, LLP

[57] ABSTRACT

An engine management system comprising engine control unit (17) which receives throttle position signals from at least two throttle position sensors (15); compares the signals; selects a preferred signal in response to a discrepancy between the signals; and operates the engine using that preferred signal.

19 Claims, 2 Drawing Sheets

AIR FUEL RATIO CONTROL

Figure 1:
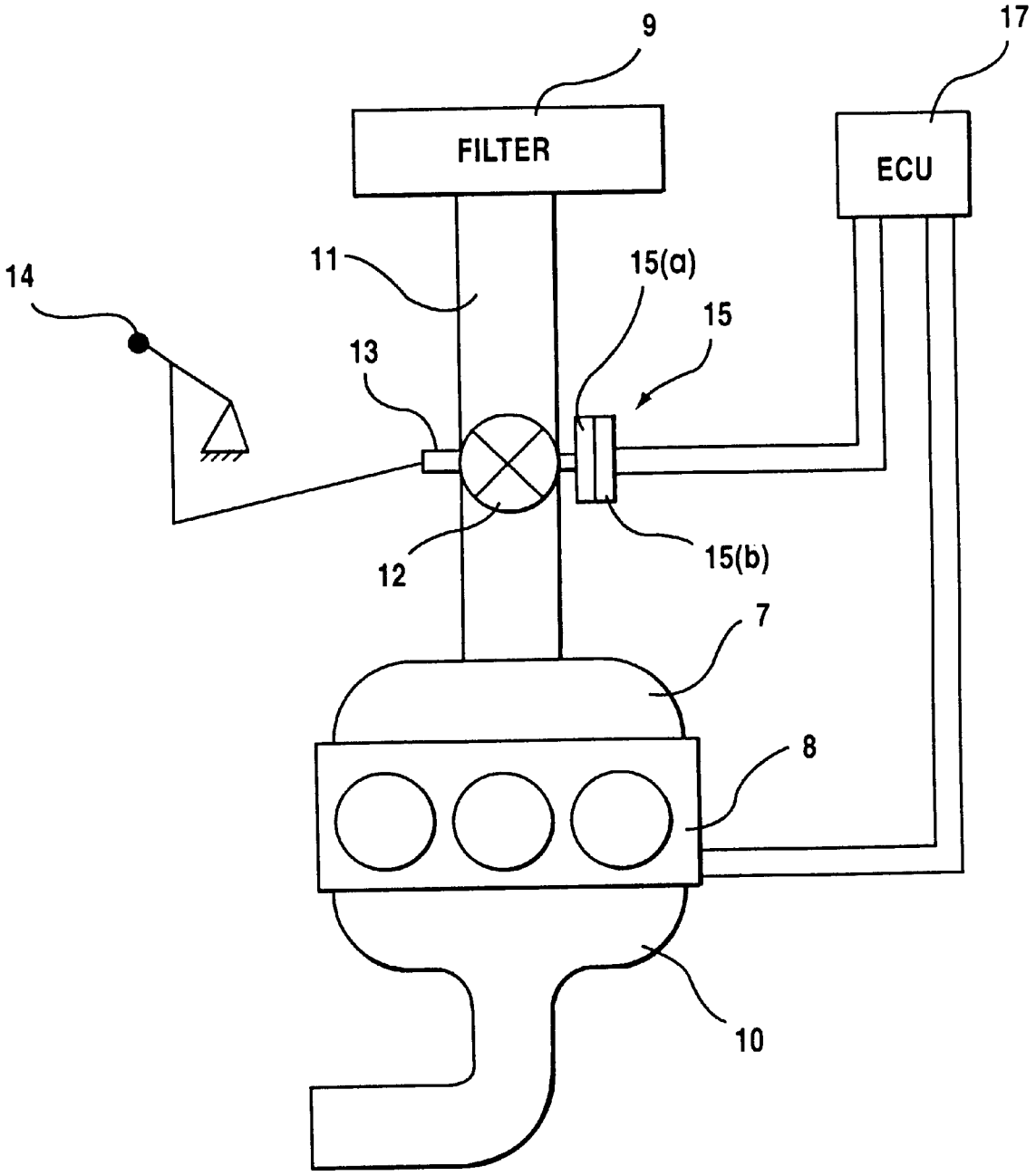

This invention relates to the control of the air fuel ratio of the combustion mixture for a fuel injected internal combustion engine.

There is known, from the Applicant's co-pending Australian Patent Application No. 34862/93, a fuel based control system. In this system, an electronic control unit for management of the engine receives signals indicating engine speed from an engine speed sensor and the engine load demand from a potentiometer or similar device attached to the driver operated throttle pedal. Based on these signals, a demand map of the electronic control unit produces a signal indicating the fuel per cycle demand of the engine. The signal indicating the fuel per cycle demand of the engine is supplied to an air demand map which determines the air per cycle demand for that fuel per cycle demand having regard to the engine speed. The air supply is then set accordingly.

It is desirable to establish a stratified fuel charge in the combustion chamber particularly at low engine loads and speeds, so that a fuel rich charge is located in the vicinity of the spark plug. At higher loads, particularly at relatively high speeds, stratification is less desirable and it would be preferred to establish a homogenous charge with fuel dispersed through the air in the combustion chamber. Thus there is a transition between a stratified and a homogenous charge regime.

In the stratified regime, immediately prior to combustion, there is an excess of air in the combustion chamber in relation to the stoichiometric air/fuel ratio, and the fuel supplied to the combustion chamber is concentrated in a given region of the chamber, generally in the vicinity of the spark plug. As such, power output is controlled by fuel input rather than the amount of air supplied to the engine, the latter being generally the case in conventional internal combustion engines. Therefore, in stratified mode operation, it is important that fuelling level is strictly controlled because incorrect fuelling may result in sudden or undesirable surges in torque and power. Clearly, it is important that such surges be avoided.

In the fuel based control system as has been discussed previously, the fuel supply is directly dependent on the sensed throttle position and thus error in the throttle position may cause the suddenness of operation previously referred to. Such error may occur, disadvantageously, if the throttle potentiometer ("pot") or similar device fails. Failure of the pot may be due to a short circuit, overheating, rust, other mechanical failure etc. This can result in various faulty outputs from the pot. For example, a pot may give zero reading, may give maximum reading, or may become fixed on an intermediate value. If the faulty throttle potentiometer reading corresponds to a high operator demand to the ECU, an undesirable fuelling level may be caused.

It is the object of the present invention to reduce the risk of engine power surging or failure of the throttle position detection system.

With this object in view, the present invention provides an engine management system comprising engine control means which receives throttle position signals from at least two throttle position sensors, compares the signals; selects a preferred signal in response to a discrepancy between the signals; and operates the engine using that preferred signal.

Preferably, the system comprises two throttle position sensors. Conveniently, the system is implemented in a fuel based control system in which fuel requirement per cycle of the engine is determined in response to engine operating conditions and, notably, engine operator demand. Preferably the throttle position sensors comprise potentiometer devices ("pots") commonly used in similar position sensor systems.

Preferably, the pots are set in electrical counter-rotation, that is rotation of the throttle valve results in an increased voltage output from one of the pots whilst the voltage output from the other pot decreases, by virtue of choosing the voltage from the wiper to ground of one of the pots and from the wiper to the supply voltage of the other pot. This reversed electrical orientation minimises the possibility of a simultaneous fault affecting both pots at the same time.

In one form of the invention, a discrepancy between sensor signals is detected when two position sensors provide the engine control means with significantly different indication of throttle position. The minimum variation between signals required for a determination that there is a discrepancy may be, for example, around 2 to 5%. This would allow for individual manufacturing tolerances in the position sensors and also "noise" interference in transmission.

It is possible that although both position sensors are operating normally, a discrepancy may exist between the output from the respective throttle position sensors due, for example, to inconsistencies or manufacturing tolerances in the assembly of the position sensor apparatus, such as the misalignment of the two sensors in relation to the throttle body. In this case, a false error reading may be given. To avoid this, a comparison of the position sensor outputs at a known operating point may be used to determine whether the discrepancy between the outputs is due to a fault in one or both of the position sensors, or is a result of a misalignment of the position sensors or some other anomaly in the sensors causing similar output discrepancies.

In a preferred embodiment of the invention, a measurement of the static difference between the two position sensors enables the engine controller to take this difference into account when determining whether the discrepancy between the position sensor outputs is sufficient to make a determination that there is a fault.

The Applicant has developed a system which adapts the output from the throttle position sensor to give an accurate reading of the actual throttle position at a given operating point or condition. A comparison may then be made with a predicted throttle position value for that known position. This system is described in Australian Provisional Patent Application No. PN7168, the contents of which are incorporated herein by reference. In this manner, measurement of the static difference between the position sensor outputs is possible at the given operating point. This measurement can be used to compensate for any output discrepancies as discussed above.

Australian Provisional Patent Application No. PN7168 also provides an adaptation system for use in setting the throttle position sensor output to give accurate throttle position information. The application of that system to the present invention results in both position sensors, if operating normally, giving similar readings without the need to compensate for the above discrepancies between the sensors.

Where position sensor failure is detected in one pot but not the other, the engine control means may select the signal from the non-failed pot as the preferred signal and operate the engine by that signal. In this case it would be beneficial to provide a warning device alerting the operator to the fact that one of the pots is not working, even though the engine is operating in the usual manner.

The preferred signal may be selected on the basis that it is the lesser of the selectable throttle position signals, that is to say the signal corresponding to the lowest fuelling rate. This gives the advantage of avoiding a falsely high signal.

Where sensing by the engine control means, which may be an electronic control unit, detects failure of both throttle position sensors, the engine management system causes the engine to operate at idle under influence of closed loop idle control.

Typically, the throttle position sensor may be a potentiometer whose physical and electrical characteristics allow operation in a given range, say 0V to 5V, with voltages in this range corresponding to particular throttle positions. However, in use, the operating range may be restricted to a smaller range such as 0.5V to 4.5V (for example by physical limitation of the throttle body). As such, under normal operation, output from the potentiometer would not reach the extreme values of 0V and 5V. An error could be assumed to have occurred in the potentiometer if these values were reached, which may occur if the potentiometer circuit is broken or short-circuited.

Within the allowable bounds, are optionally provided threshold values for idle and wide open throttle (WOT).

Conveniently, the preferably two throttle position sensors or potentiometers comprise part of an assembly in which the sensors are mechanically connected so that a movement in the throttle produces a corresponding rotational motion on the shaft of the potentiometers. The output of each sensor is fed to the electronic control unit. Preferably, the signals from the throttle position sensors are filtered in order to avoid transmission noise, which is capable of causing an erroneous indicated throttle position. The filter may be configured such that no filtering exists unless the signal velocity exceeds a predetermined value.

In addition to other abnormal conditions previously described, an abnormal condition may be sensed in a case where the indicated movement of the throttle exceeds a mechanical limit, being that movement allowed by virtue of the mechanical arrangement and any physiological limitation of the operator. The electronic control unit may be provided with maximum rates of change of throttle position for a given throttle mechanism and operator type. In this way, the electronic control unit is able to compare the acceleration rate of the throttle position output from each of the position sensors with the predetermined maximum rate and then make a determination as to whether each of the position sensors is operating normally. In the case where a difference error is detected between the at least two throttle position sensors, the output acceleration rate may be used to determine which of them is producing the erroneous reading.

According to another preferred embodiment of the invention, following a determination that there is a discrepancy between the two throttle position sensor signals, and where neither throttle position sensor is found to have failed, one of the position sensor signals may be selected as the preferred signal on the basis of a predetermined position sensor signal pattern. For example, the engine operator may be instructed that following an indication of throttle pot sensor failure (eg via failure indicator light), the operator should move the throttle from zero throttle to full throttle and back three times. In a case where a discrepancy in the throttle position readings has occurred, and the question of which throttle position sensor has failed is unresolvable by other failure detection methods, a warning lamp may be lit. If, following this a signal indicating that one of the throttle position sensors has moved from zero to full throttle and back three times is received, the throttle position sensor from which this signal was received may be assumed to be the correctly operating sensor. Of course, any predetermined position sensor signal pattern may be used to provide an indication that the position sensor from which the signal is received is operating correctly.

An error signal may also be given where the transition from low signal output from the pot to high signal output is not continuous. This may be useful where part of the pot has been affected by rust, etc.

Figure 2:
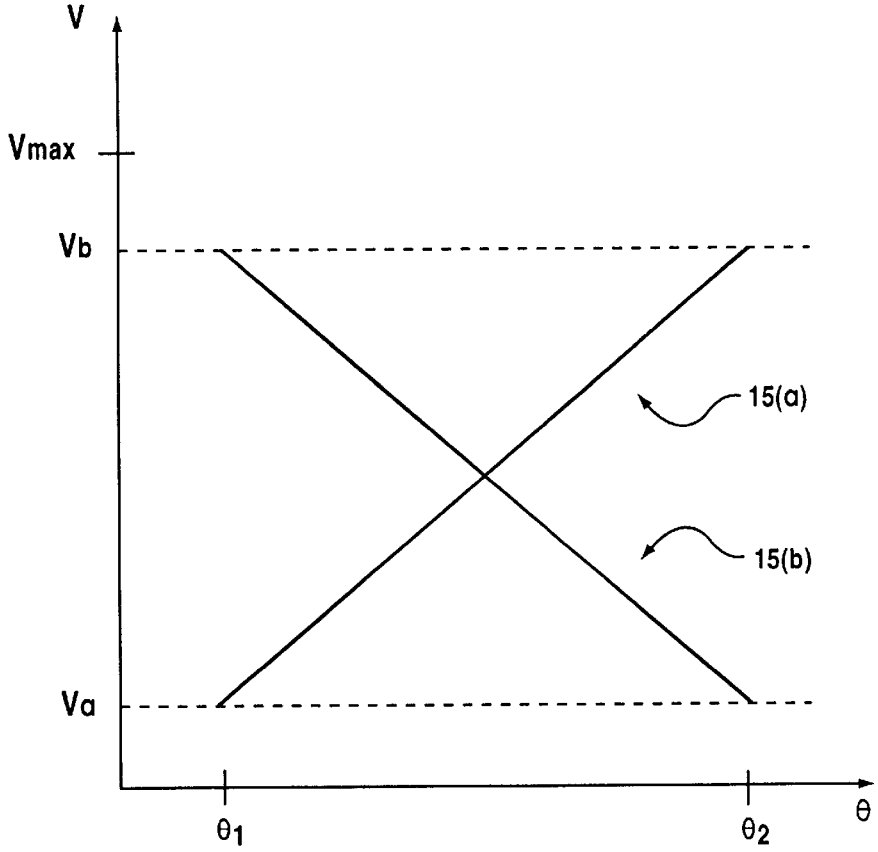
Figure 3:
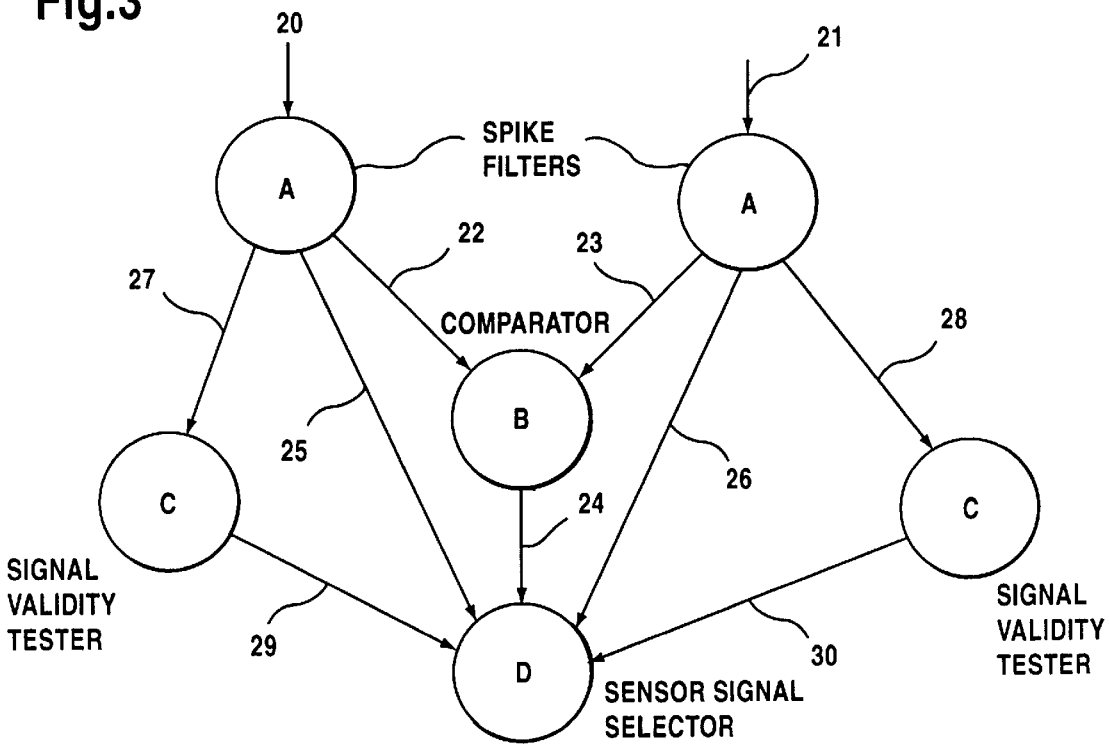

The invention will be better understood from the following description of preferred embodiments thereof made with reference to the accompanying drawings in which:

FIG. 1 is a representation of an engine operated in accordance with a fuel based control strategy;

FIG. 2 shows a plot of V against position (θ) for the two throttle pots (15(*a*) and 15(*b*)). $V_a$ and $V_b$ correspond to minimum and maximum operating voltages. $V_{max}$ is maximum voltage applied to the pot. $\theta_1$ and $\theta_2$ are the physical extremes of the throttle body angle/pot angle defining mechanical limits of the device; and FIG. 3 is a flow diagram representing operation of twin throttle pots.

Referring now to FIG. 1 of the drawings, there is shown a three cylinder marine engine 8 including an air intake manifold 7 and an exhaust manifold 10. The intake manifold 7 is in communication with an air intake passage 11 which receives air through a conventional air filter box 9. Mounted in the air intake passage 11 is a motor controlled throttle valve 12.

The engine 8 can be considered to be representative of a marine engine in which the throttle valve 12 is manually actuated by way of an operator controlled throttle lever 14. It is to be appreciated that the marine engine 8 is such that, as in many conventional marine engines, the engine is not able to be cranked until the throttle lever 14, which also typically controls gear selection, has been returned to the neutral position which corresponds to idle operation of the engine 8.

In operation, as the driver actuates the throttle pedal 14 from an idle position, the throttle potentiometer 15, typically of resistive wiper contact type, will provide a signal to the engine control means or electronic control unit (ECU) 17 of the engine indicating the load demand thereof. The ECU 17, which is provided with an appropriate look-up map, will determine therefrom the fuelling rate required by the engine 8 to achieve the desired air/fuel ratio in the combustion chambers thereof. Hence, it will be understood from the foregoing that the throttle position setting is of great importance to establishment of a correct air/fuel ratio and optimal control of the engine 8.

Accordingly, it follows from this that calibration of the throttle pot 15 is important to appropriate setting of the throttle position for conditions throughout the operating range of the engine 8. It is additionally to be observed that the above described arrangement is a system where the throttle position sensor 15 is a primary sensor so accuracy is of heightened importance.

The throttle position sensors or potentiometers 15(*a*) and 15(*b*) may be mounted on a shaft 13 directly connected to the throttle means 12, the shaft 13 being directly driven from the manually actuated throttle lever 14. Thus, in operation, the throttle lever 14 will be moved by the operator to a desired position and hence move the shaft 13 acting to open and close the throttle means 12. It is of course to be appreciated that the throttle position sensors 15(*a*) and 15(*b*) may be located at other suitable locations. For example, the sensor(s) 15 could be arranged adjacent or in working relation to the throttle lever 14 such that different positions of the lever 14 correspond to different engine fuelling rates. Alternatively, the sensor(s) 15 could be located on an independent cam means actuated by the throttle lever 14 which in turn actuates the throttle means 12.

This movement will cause a voltage signal to be generated by the throttle pot 15 which may be employed by the ECU 17 as a measure of driver demand. The signal may be input to a look-up map which provides a particular fuel per cycle (FPC) setting for the given driver demand. Although the throttle position indication could be used as a sole input to the FPC look-up map, this may be a compromised system. Advantageously, driver demand and engine speed are to be input to the look-up map of the ECU 17 to provide the desired fuel based control strategy and the FPC of the engine 8. Further description of such an air/fuel ratio control strategy may be found in the applicant's co-pending Australian Patent Application No. 34862/93, the contents of which are hereby incorporated by reference. It will also be understood that while the above description relates in the main to a fuel based control system, there is no reason, in principle, why air per cycle (APC) cannot be set first.

In accordance with output FPC, appropriate APC is set to establish the required air/fuel ratio of the engine 8. If an air based control system were employed, appropriate FPC would subsequently be set.

As described hereinabove, throttle pots 15(*a*) and 15(*b*) comprise part of an assembly in which the pots are mechanically connected so that a movement in the throttle produces a corresponding rotational motion on the shaft of the pots.

The pots are oriented with respect to each other such that rotation of the throttle body results in an increased voltage output from pot 15(*a*) as the voltage output from pot 15(*b*) decreases. The characteristic of V v θ for this mode of orientation is conveniently seen in FIG. 2.

Referring to FIG. 3 of the drawings, data 20, 21 from pots is input, in the form of a raw voltage signal, to respective "spike filters (A)". A comparison is done in comparator module (B) and any difference error 24 is determined and fed to sensor signal selector (D). Spike filters (A), comparator module (B) and sensor signal selector (D) may be embodied in an engine control unit, ECU 17, of electronic type.

Output 27,28 from filters is also fed direct 25, 26 to sensor selector (D) for use in determining fuelling rate, if the signal is deemed acceptable.

Signal validity tests on filter output 27, 28 are also performed in modules (C) and the results 29, 30 of these tests are fed to sensor selector (D).

Where a difference error is detected in the comparison between throttle pots 15(*a*) and 15(*b*), the sensor selector checks whether either pot has shown a validity error.

If neither have a validity error, the ECU then checks the preceding output acceleration behaviour of each of the pots. Where an anomalous output acceleration reading is detected, the ECU may determine that the pot producing the anomalous output has failed and operation may continue using the other pot. An anomalous output may be one where the output from the pot changed from zero to maximum in an extremely short period of time (eg shorter than would normally be possible in relation to the operator's physical capabilities). Various outputs from the pots may be predetermined as anomalous, and thus recognisable by the ECU.

If neither pot exhibits anomalous output acceleration rates, then the selector chooses the signal corresponding to the lower fuelling rate, to ensure safe operation of the engine.

If one has a validity error, then the selector chooses the signal from the pot which does not have a validity error.

If both have a validity error, the engine reverts to idle mode.

Alternative control modes may be set up. For example, where either pot fails the validity test the engine may revert to idle mode.

Further, it may be equally undesirable at high speed to suddenly revert to idle, so the return to idle can be graduated by controlled reduction of fuelling from current level to idle. Many alternatives are possible and may be apparent to those skilled in the art on reading this disclosure.

One problem which may arise with the use of dual position sensors is that any error in the initial relative positioning of the sensors themselves can result in a perceived difference error between the first and second pots where, in fact, there is no error at all, a "false positive". That is, the engine management system may detect a difference error reading due, not to an error in function of the position sensor, but to the initial relative positioning of respective sensors. To avoid this situation, it is possible to include compensation means to configure the engine management system to calculate the initial signal difference due to misalignment of the position sensors, and to allow for this in future calculations of the difference error.

The above description is not intended to be limiting of the present invention and is provided for the purposes of exemplification. Modifications and variations may be apparent to those skilled in the art on reading the disclosure and are included within the scope of the present invention.

We claim:

1. An engine management system for managing an internal combustion engine having a throttle, comprising:

at least two throttle position sensors, each throttle position sensor outputting a throttle position signal;

comparator means for comparing said throttle position signals;

selector means connected to said comparator means for selecting a preferred throttle position signal if a discrepancy is detected between any of said throttle position signals by said comparator means, wherein the engine is operated using said preferred throttle position signal.

2. An engine management system as claimed in claim 1, wherein limits of a sensor operational output range are within an absolute operating range of each throttle position sensor, such that each throttle position sensor is capable of giving signals outside its sensor operational output range.

3. An engine management system as claimed in claim 1 wherein signals from said sensors are filtered to remove noise.

4. An engine management system as claimed in claim 1 wherein sensor failure is detected where indicated movement of said throttle exceeds a mechanical limit for said throttle.

5. An engine management system as claimed in claim 1 wherein said potentiometers are interconnected so that a movement in throttle position produces a corresponding movement in both potentiometers.

6. An engine management system as claimed in claim 1 wherein said engine management system implements a fuel based control strategy.

7. An engine management system as claimed in claim 1 wherein driver demand and engine speed are inputs to said engine management system for determination of said fuel based control strategy.

8. An engine management system as claimed in claim 1 further comprising a signal validating tester for validating said throttle position signals.

9. An engine management system as claimed in claim 8 wherein failure to validate the signal causes the engine to operate at idle.

10. An engine management system as claimed in claim 1 wherein fuelling is gradually varied to achieve idle if said discrepancy between throttle position signals is detected.

11. An engine management system as claimed in claim 1 including compensation means for compensating for initial relative positioning of said throttle position sensors.

12. An engine management system as claimed in claim 1 wherein said engine control means implements an air based control strategy.

13. An engine management system as claimed in claim 1, wherein an indicated throttle position acceleration rate is monitored for each throttle position sensor, and used to determine whether the throttle position sensors are operating normally.

14. An engine management system as claimed in claim 13 wherein an acceleration rate higher than a predetermined limit will result in a determination that a throttle position sensor corresponding to said higher acceleration rate has failed.

15. An engine management system as claimed in claim 1, wherein an operator initiated throttle position sensor signal is used to determine whether sensor failure has occurred.

16. An engine management system for managing an internal combustion engine having a throttle, comprising:

first and second throttle position sensors connected to said throttle, wherein said first and second throttle position sensors each comprise a potentiometer, said first and second potentiometers being set in electrical counter rotation, and each potentiometer outputting a throttle position signal;

comparator means for comparing said throttle position signals;

selector means connected to said comparator means for selecting a preferred throttle position signal if a discrepancy greater than a predetermined amount is detected between said throttle position signals by said comparator means, wherein the engine is operated using said preferred throttle position signal.

17. An engine management system for managing an internal combustion engine having a throttle, comprising:

at least two throttle position sensors connected to said throttle, each throttle position sensor outputting a throttle position signal;

comparator means for comparing said throttle position signals;

selector means connected to said comparator means for selecting a preferred throttle position which has the smallest value of said throttle position signals if a discrepancy greater than a predetermined amount is detected between said throttle position signals by said comparator means, wherein said engine is operated using said preferred throttle position signal.

18. An engine management system for managing an internal combustion engine having a throttle, comprising:

at least two throttle position sensors connected to said throttle, each throttle position sensor outputting a throttle position signal;

comparator means for comparing said throttle position signals;

selector means connected to said comparator means for selecting a preferred throttle position signal if a discrepancy greater than a predetermined amount is detected between any of said throttle position signals and an expected signal by said comparator means; wherein, if said discrepancy is detected in two throttle position sensors, the engine is caused to operate at idle.

19. An engine management system for managing an internal combustion engine having a throttle, comprising:

at least two throttle position sensors connected to said throttle, each said throttle position sensor outputting a throttle position signal;

comparator means for comparing said throttle position signals with a predicted value at a known throttle position;

selector means connected to said comparator for selecting a preferred throttle position signal if a discrepancy greater than a predetermined amount is detected by said comparator means between any of said throttle position signals and said predicted value, wherein the engine is operated using said preferred throttle position signal.

* * * * *

UNITED STATES PATENT AND TRADEMARK OFFICE

CERTIFICATE OF CORRECTION

PATENT NO. : 5,899,191

DATED : May 4, 1999

INVENTOR(S) : Rabbitt et al.

It is certified that error appears in the above-identified patent and that said Letters Patent is hereby corrected as shown below:

Item [19]
Delete "Rabbit et al." insert therefor -- Rabbitt et al. --

Item [75], line 1, delete "Rabbit" insert therefor -- Rabbitt --

Signed and Sealed this

Sixteenth Day of November, 1999

*Attest:*

*Attesting Officer*

Q. TODD DICKINSON

*Acting Commissioner of Patents and Trademarks*